US007625080B2

(12) United States Patent
Hess et al.

(10) Patent No.: US 7,625,080 B2
(45) Date of Patent: Dec. 1, 2009

(54) AIR MANAGEMENT IN A FLUID EJECTION DEVICE

(75) Inventors: Jeffery S Hess, Corvallis, OR (US); Philip H. Harding, Albany, OR (US); Manish Giri, Corvallis, OR (US); Gilbert G. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 897 days.

(21) Appl. No.: 10/872,215

(22) Filed: Jun. 18, 2004

(65) Prior Publication Data

US 2005/0280680 A1 Dec. 22, 2005

(51) Int. Cl.
*B41J 2/165* (2006.01)

(52) U.S. Cl. ..... 347/92; 347/84; 347/85; 347/29; 347/86

(58) Field of Classification Search ..... 347/92, 347/28, 29, 30, 21, 12, 84, 85, 86
See application file for complete search history.

(56) References Cited

U.S. PATENT DOCUMENTS

| | | | | |
|---|---|---|---|---|
| 5,394,181 | A | 2/1995 | Braun | |
| 5,455,615 | A | 10/1995 | Burr et al. | |
| 6,120,139 | A * | 9/2000 | Childers et al. | 347/92 |
| 6,179,414 | B1 * | 1/2001 | Keefe et al. | 347/65 |
| 6,270,200 | B1 * | 8/2001 | Ishinaga et al. | 347/65 |
| 6,409,317 | B1 | 6/2002 | Shimazu et al. | |
| 6,474,791 | B2 | 11/2002 | Ishinaga et al. | |
| 6,488,364 | B1 | 12/2002 | Nakajima et al. | |
| 2002/0186286 | A1 * | 12/2002 | Roof et al. | 347/86 |
| 2003/0067523 | A1 * | 4/2003 | Shimosato | 347/92 |
| 2004/0165047 | A1 | 8/2004 | Takata | |
| 2004/0207683 | A1 * | 10/2004 | Sonobe | 347/23 |

FOREIGN PATENT DOCUMENTS

| | | | |
|---|---|---|---|
| EP | 1260372 | | 11/2002 |
| EP | 1260372 | A2 * | 11/2002 |
| EP | 1302323 | | 4/2003 |
| EP | 1302323 | A2 * | 4/2003 |
| JP | 55-128465 | | 10/1980 |
| JP | 01166963 | | 6/1989 |

* cited by examiner

*Primary Examiner*—Stephen D Meier
*Assistant Examiner*—Laura E Martin

(57) ABSTRACT

One exemplary fluid ejection device includes a substrate having one or more layers positioned thereon. The fluid ejection device also includes a fluid-feed path extending through a space which is defined, at least in part, by the one or more layers. The fluid ejection device including methods and structures for managing air and amongst other things gas bubble formation.

27 Claims, 15 Drawing Sheets

AIR MANAGEMENT IN A FLUID EJECTION DEVICE

BACKGROUND

Air in the form of bubbles can be present in various fluid ejection devices, such as print heads. In some fluid ejection devices bubbles can reduce and/or occlude fluid flow and cause the device to malfunction. Management of the air bubbles can enhance the performance and reliability of the fluid ejection device

BRIEF DESCRIPTION OF THE DRAWINGS

The same components are used throughout the drawings to reference like features and components wherever possible. Alphabetic suffixes are utilized where appropriate to distinguish different embodiments. The diagrammatic representations illustrated herein are for illustrative purposes and may not be to scale.

DETAILED DESCRIPTION

The embodiments described below pertain to methods and systems related to fluid ejection devices such as print heads. As such, the term "ink" will be used in the following description, but other fluids are utilized in suitable embodiments.

Among other origins air in the form of bubbles may be formed in the ink as a byproduct of operation of a printing device. For example bubbles may be formed as a byproduct of the ejection process in the printing device's print cartridge when ink is ejected from one or more chambers.

If bubbles accumulate within the fluid ejection device, e.g. print head, the bubbles may occlude ink flow to some or all of the chambers and may cause the fluid ejection device to malfunction. Some embodiments provide structures and methods that may purge air and/or bubbles from the fluid ejection device to decrease the likelihood of such a malfunction as will become apparent below.

Figure 1:
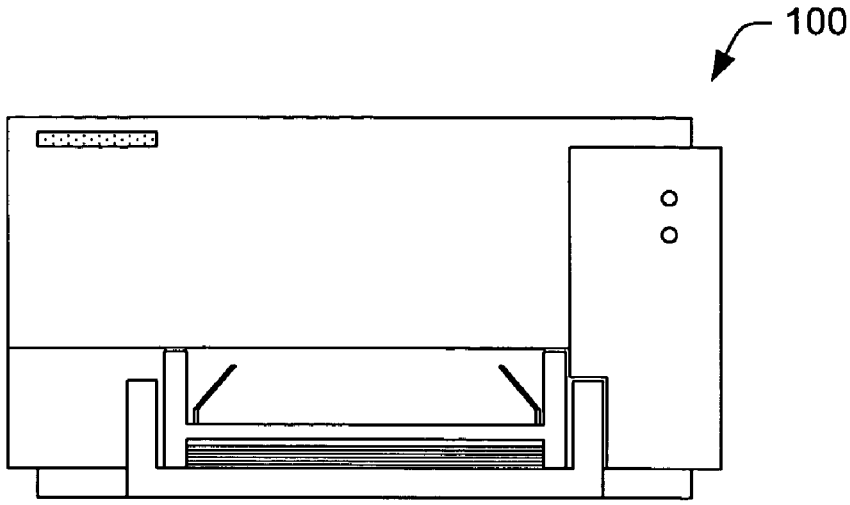
FIG. 1 illustrates a front elevational view of an exemplary printer in accordance with one embodiment.

FIG. 1 shows an exemplary printing device in accordance with one embodiment. In this embodiment the printing device comprises a printer 100. The printer shown here is embodied in the form of an inkjet printer. The printer 100 may be capable of printing in black-and-white and/or color. The term "printing device" refers to any type of printing device and/or image forming device that employs a fluid ejection device(s) such as in a print cartridge to achieve at least a portion of its functionality. Examples of such printing devices may include, but are not limited to, printers, facsimile machines, photocopiers, and the like. Examples of other fluid ejection devices may include various devices such as Lab-On-A-Chip used in various medical and laboratory setting among others.

Figure 2:
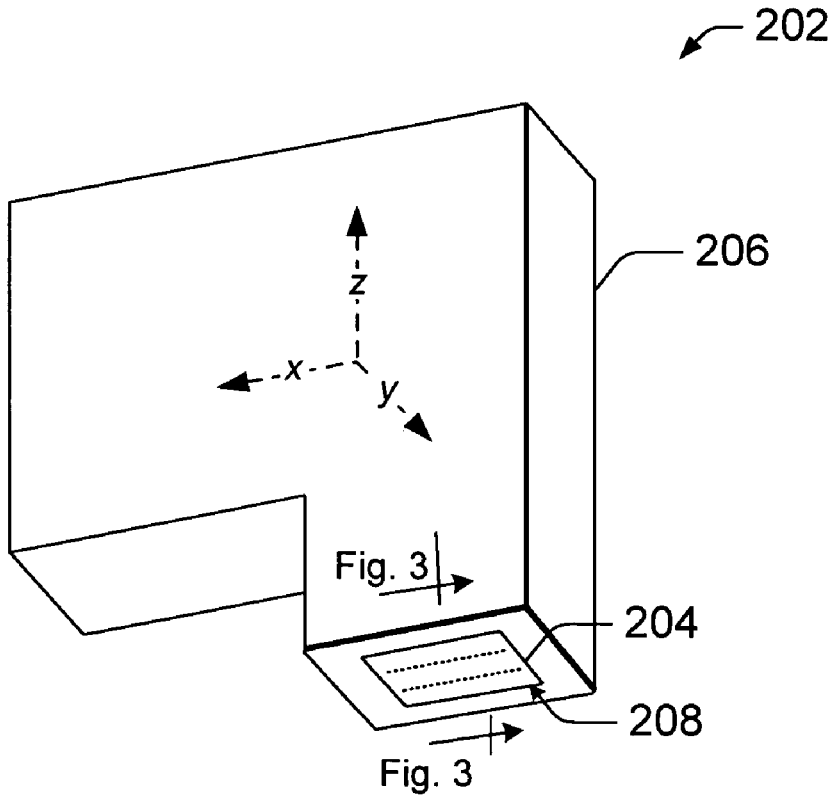
FIG. 2 illustrates a perspective view of an exemplary print cartridge in accordance with one embodiment.

FIG. 2 shows an exemplary print cartridge 202 that may be used in an exemplary printing device such as printer 100. Print cartridge 202 is comprised of a print head 204 and a cartridge body 206 configured to couple with the print head. Cartridge body 206 may supply ink to print head 204 and may contain an internal ink supply and/or be connected to an external ink supply. Ink received by print head 204 may be ejected in the form of droplets from an outwardly facing surface 208.

While a single print head 204 is shown on print cartridge 202, other print cartridges may have multiple print heads on a single print cartridge. Some suitable print cartridges may be disposable, while others may have a useful lifespan equal to or exceeding that of the printing device. Other exemplary configurations will be recognized by those of skill in the art.

Figure 3:
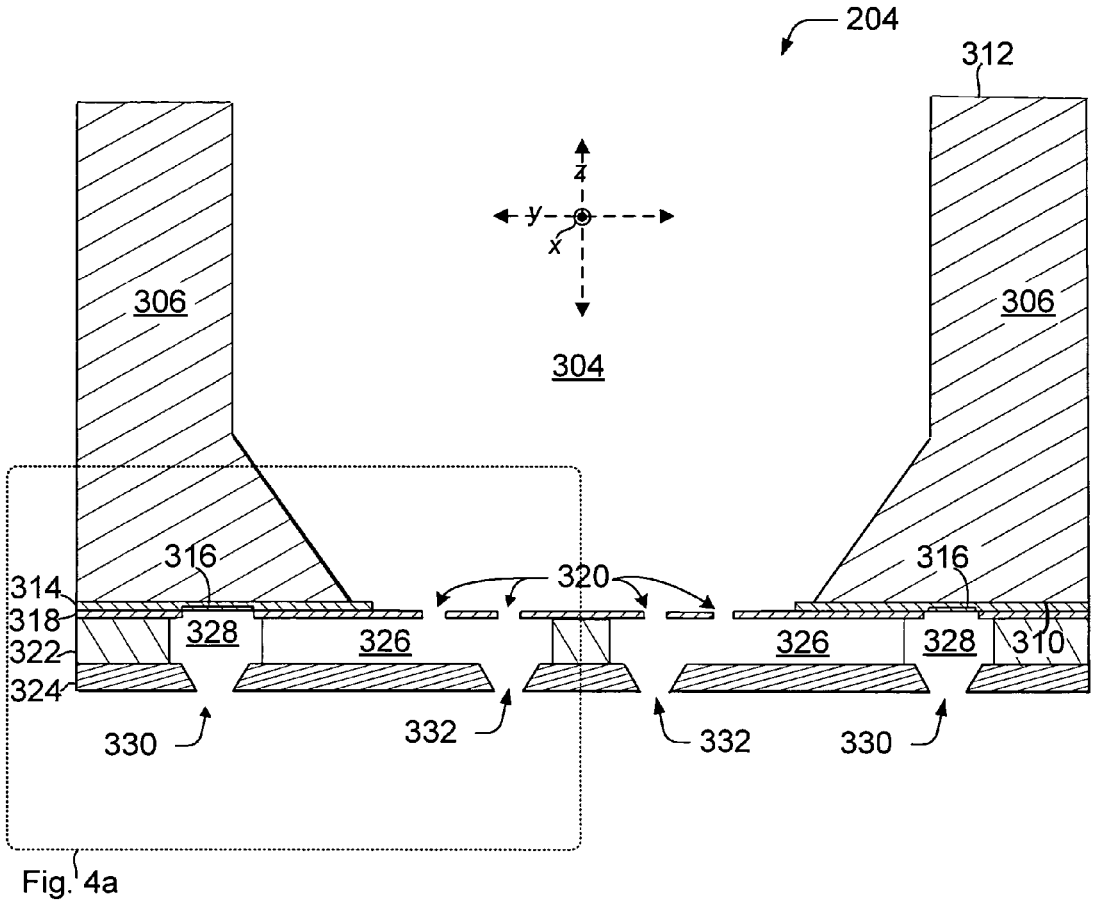
FIG. 3 illustrates a cross-sectional view of a portion of an exemplary print head as shown in FIG. 2 in accordance with one embodiment.

FIG. 3 shows a cross-sectional representation of print head 204 as shown in FIG. 2. This cross-sectional view is taken along the y-axis of print head 204. A slot or slots 304 passes through a substrate 306 from a first substrate surface 310 to a generally opposite second substrate surface 312. Slot 304 may have any suitable dimensions. For example, the slot may have any suitable length as measured parallel to the x-axis, with some embodiments having slots in the range of 20,000 microns. Similarly, any suitable slot width taken parallel to the y-axis may be utilized, with many embodiments utilizing slot widths in the 100-200 micron range. Both narrower and wider widths are also suitable.

In this particular embodiment, substrate 306 comprises silicon which either may be doped or undoped. Other substrate materials may include, but are not limited to, gallium arsenide, gallium phosphide, indium phosphide, glass, quartz, ceramic or other material.

Substrate thickness t may have any suitable dimensions that are appropriate for an intended application. In some embodiments substrate thicknesses t may range from less than 100 microns to more than 2000 microns. One exemplary embodiment may utilize a substrate that is approximately 675 microns thick, though if the current trend toward miniaturization continues, future embodiments may commonly utilize substrates having a thickness of 100-300 microns or less.

Though a single substrate is discussed herein, other suitable embodiments may comprise a substrate that has multiple components during assembly and/or in the finished product. For example, one such embodiment may employ a substrate having a first component and a second sacrificial component which is discarded at some point during processing.

One or more thin-film layers 314 may be positioned over first surface 310. Thin-film layers 314 may form various electrical components, such as heating element 316 and/or piezoelectric crystals, transistors and electrical traces which are not specifically shown. Individual heating elements 316 are electrically connected to individual electrical traces. Electrical energy may be selectively supplied to the heating elements to cause ink to be ejected from print head 204. Embodiments utilizing other electrical components such as piezoelectric crystals or other ejection means may be energized similarly to eject ink.

In some embodiments one or more of a filter 318 that has apertures 320 formed therein, a barrier layer 322 and an orifice layer 324 may be positioned adjacent thin-film layers 314. Ink may pass from slot 304 through apertures 320 to ink-feed passageways ("passageways") 326. Ink may be supplied from an individual passageway 326 to a chamber 328.

Passageways 326 and chambers 328 may be defined at least in part by barrier layer 322. Ink may be ejected selectively from a chamber 328 via a respectively positioned nozzle 330 formed in orifice layer 324. Nozzles 330 comprise a first nozzle type. A second different nozzle type also is defined by orifice layer 324 in some embodiments. In this embodiment the second nozzle type comprises an air purge opening 332 configured to evacuate bubbles from the print head as will be discussed in more detail below.

In one embodiment filter 318 comprises a generally planer photo-imagable polymer filter layer positioned over the substrate's first surface 310. In this particular embodiment the photo-imagable filter layer is spun-on over the thin-film layers 314 prior to completion of slot 304. The photo-imagable filter layer is patterned and etched to form apertures 320. Further, in this embodiment, barrier layer 322 is positioned over filter 318 before etching. The skilled artisan will recognize other suitable configurations. For example, other filters may comprise different materials and/or may utilize other aperture shapes and/or sizes. In one such example a stainless steel filter may be utilized.

Individual heating elements 316 may be positioned within or proximate to an individual chamber 328. In some embodiments chamber(s) 328 may be defined, at least in part, by barrier layer 322 and orifice layer 324. Other configurations are also possible. In this embodiment passageway 326 and chamber 328 are patterned into barrier layer 322. As will be recognized by the skilled artisan, this is but one suitable configuration. Barrier layer 322 may comprise, among other materials, a patternable material such as a photo-imagable polymer substrate, however, other material may be utilized.

In one embodiment orifice layer 324 comprises a nickel substrate. In another embodiment orifice layer 324 is the same material as the barrier layer. The various layers may be formed, deposited, or may be attached upon the preceding layers. The configuration given here is but one possible configuration. For example, in an alternative embodiment, orifice layer 324 and barrier layer 322 comprise a single layer of material.

Figure 4A:
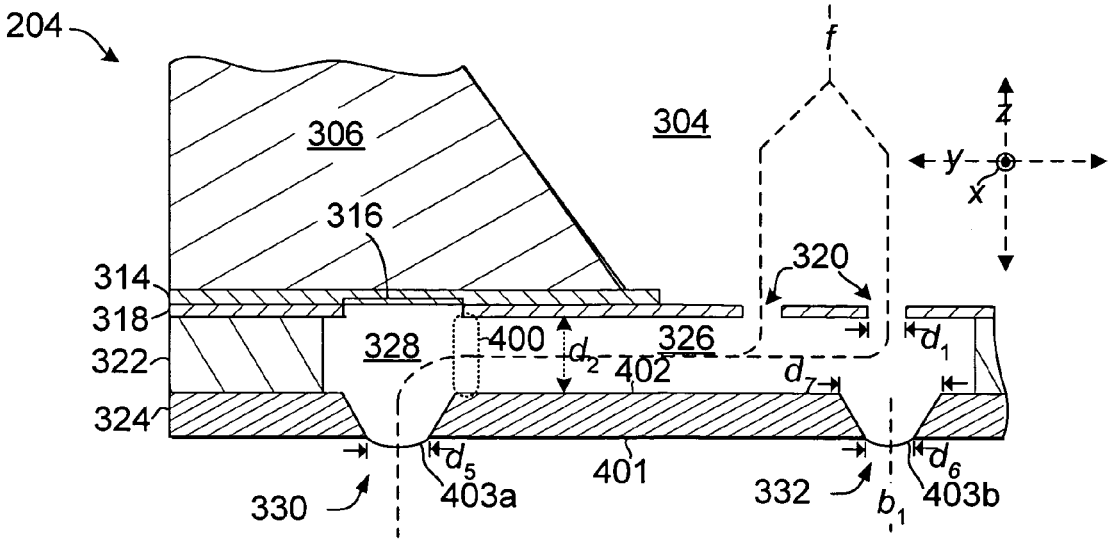
FIGS. 4*a*, 4*c*, 4*e*, 4*g*, 4*i*, 4*k*, 4*m*, and 4*o* illustrate an enlarged cross-sectional view of a portion of the exemplary fluid ejection device shown in FIG. 3 in accordance with one embodiment.
Figure 4B:
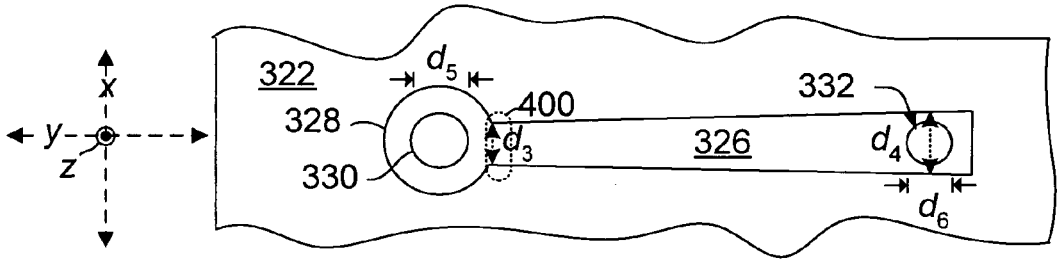
FIGS. 4*b*, 4*d*, 4*f*, 4*h*, 4*j*, 4*l*, and 4*n* illustrate top views of a portion of the fluid ejection device shown in FIGS. 4*a*, 4*c*, 4*e*, 4*g*, 4*i*, 4*k*, and 4*m*, respectively in accordance with one embodiment.
Figure 4C:
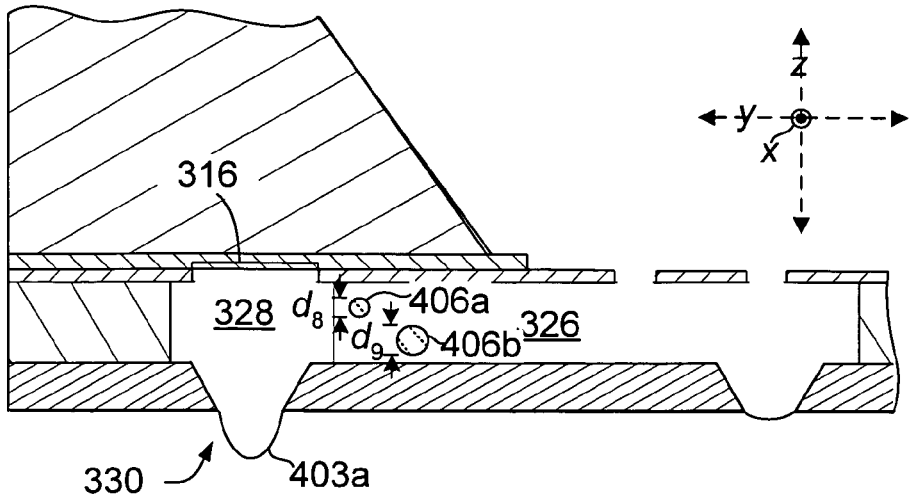
Figure 4D:
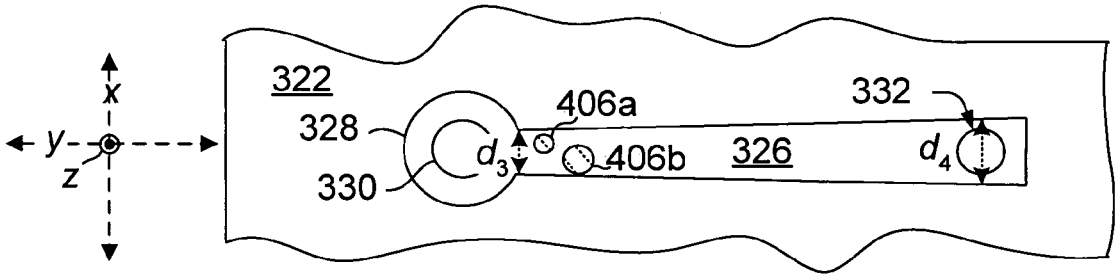
Figure 4E:
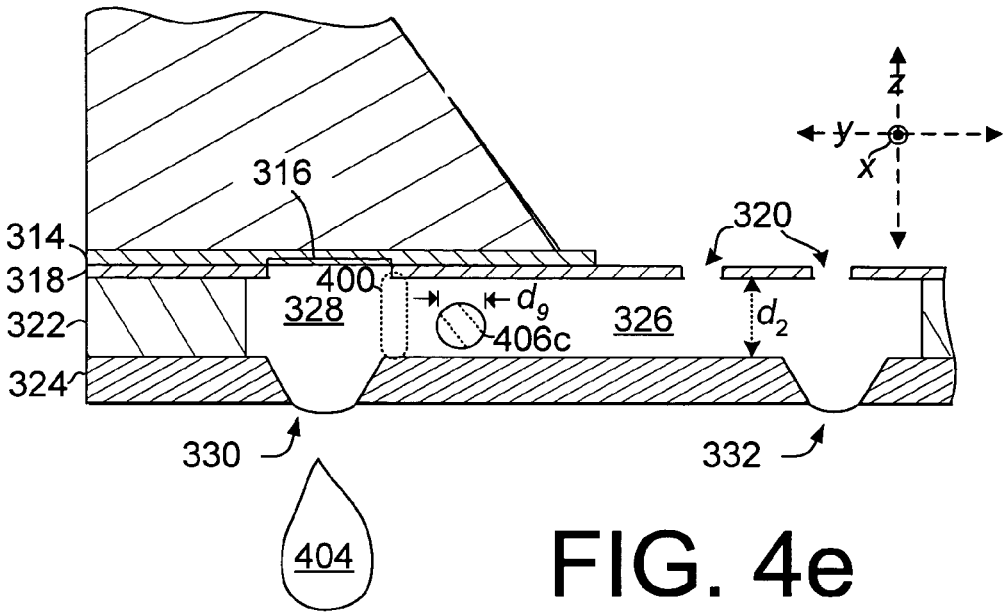
Figure 4F:
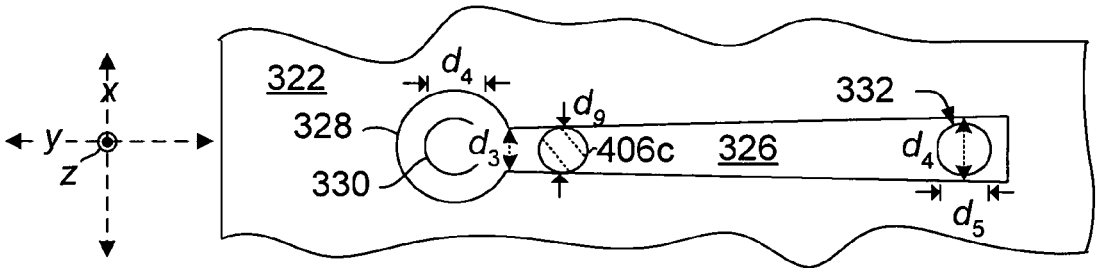
Figure 4G:
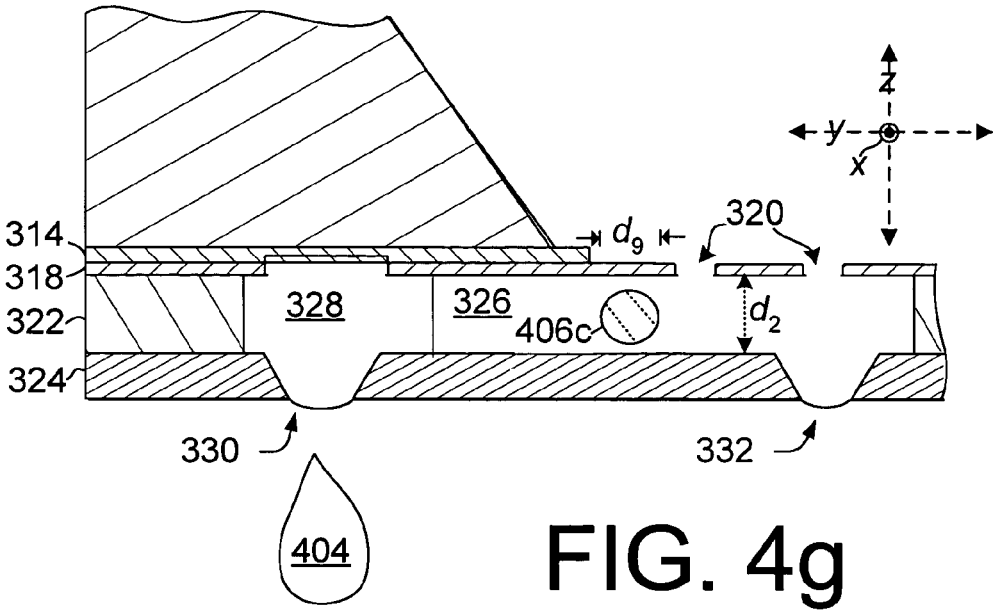
Figure 4H:
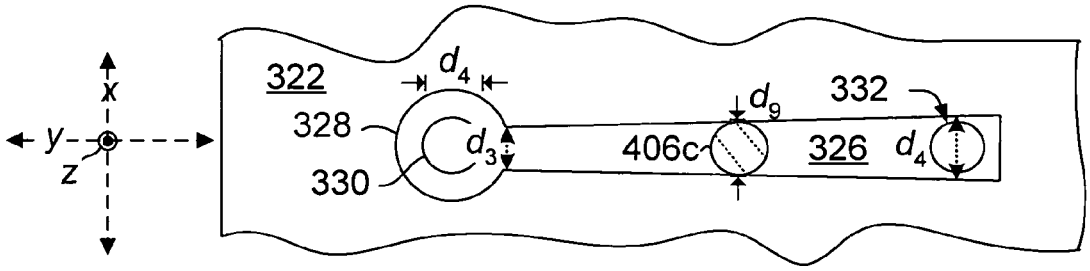
Figure 4I:
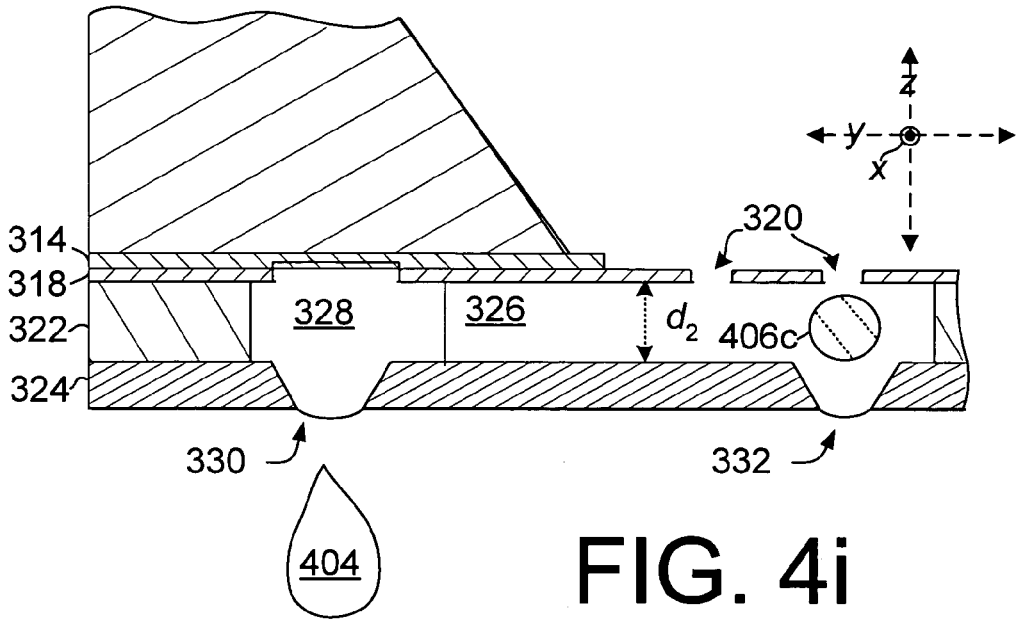
Figure 4J:
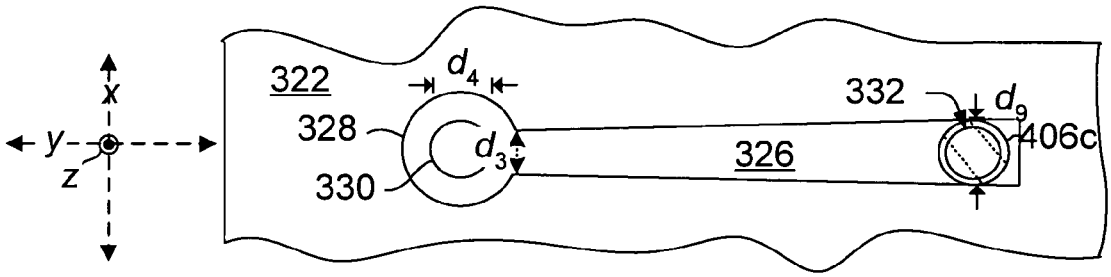
Figure 4K:
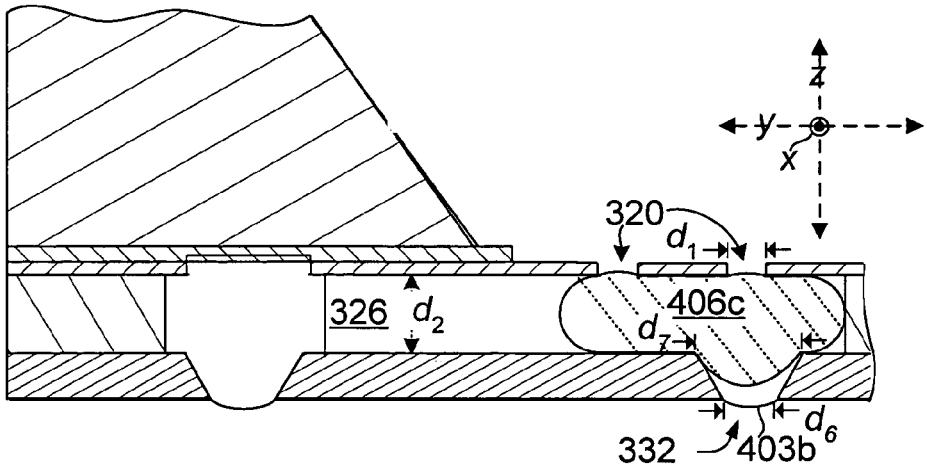
Figure 4L:
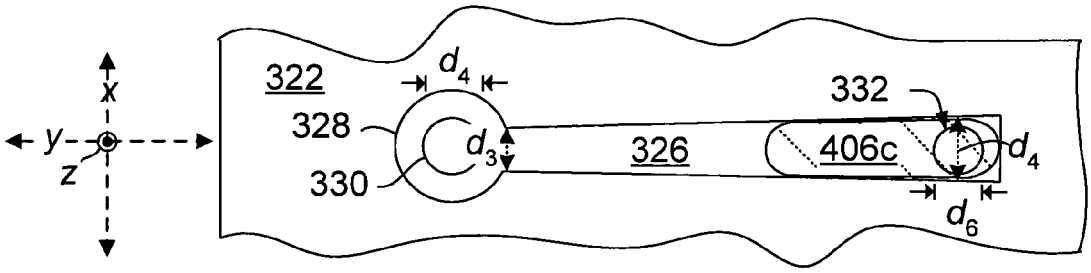
Figure 4M:
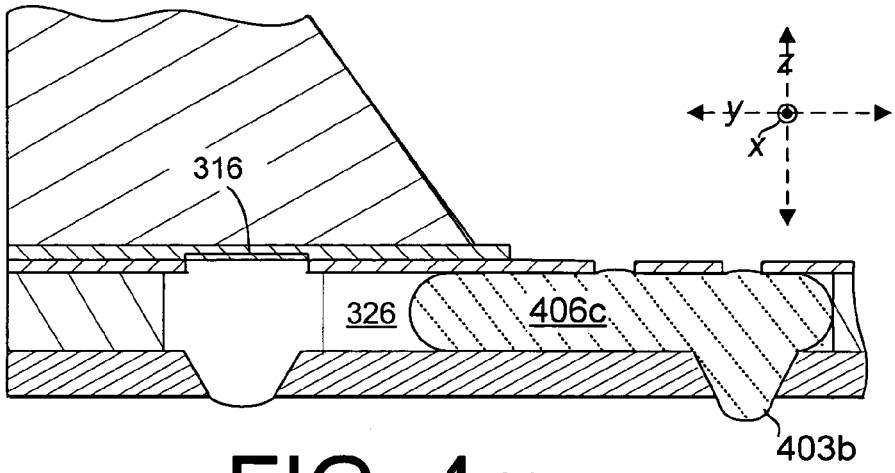
Figure 4N:
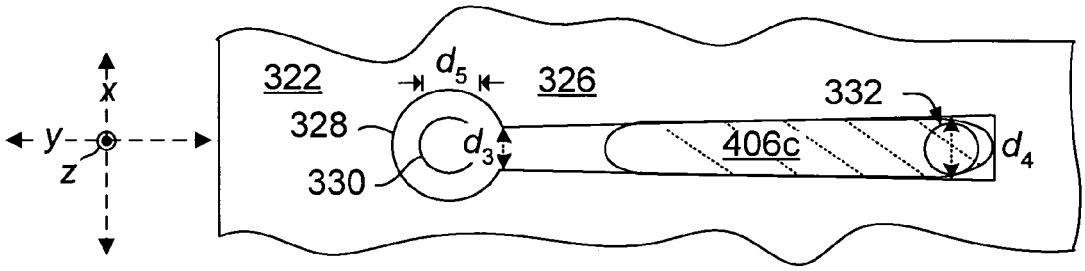
Figure 4O:
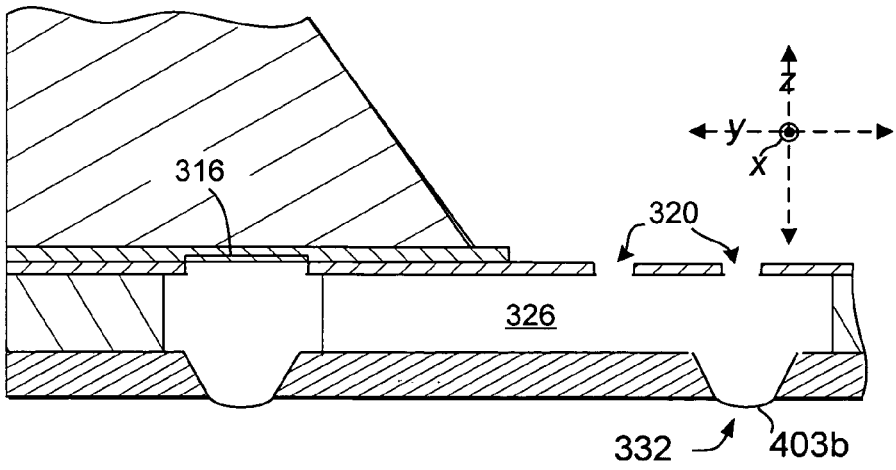

FIGS. 4*a*-4*o* illustrate a portion of print head 204 as indicated in FIG. 3. FIGS. 4*a*, 4*c*, 4*e*, 4*g*, 4*i*, 4*k*, 4*m* and 4*o* illustrate cut-away cross-sectional views taken transverse to slot 304 along the x-axis. FIGS. 4*b*, 4*d*, 4*f*, 4*h*, 4*j*, 4*l* and 4*n* illustrate top views of a portion of print head 204 taken along a xy-plane.

FIGS. 4*a*-4*b* illustrate a portion of a fluid path f extending from slot 304 and out through nozzle 330. Passageway 326 defines a portion of fluid path f and is fluidly coupled to adjoining structures including chamber 328 and slot 304 through apertures 320 and passageway-to-chamber opening 400.

Apertures 320 are configured to allow ink into passageway 326 from slot 304. In this embodiment two apertures 320 supply passageway 326. Other embodiments may utilize more or less apertures to supply a passageway. Alternatively or additionally, other supply configurations also may be utilized, examples of which will be discussed below.

In this embodiment individual apertures 320 are generally circular when viewed transverse to fluid path f. Apertures 320 have a diameter $d_1$, which in one embodiment is approximately about 8 microns measured orthogonally to fluid path f. Herein, openings such as apertures 320 will be described with a single dimension comprising a diameter where the opening is circular when viewed transverse fluid path f. Other configurations will be described with two dimensions such as a width and a height or a width and a length each taken orthogonal to a respective portion of fluid path f passing through the opening. The respective portion of the fluid path may be considered to comprise a bore axis of the opening.

In the embodiment of FIGS. 4*a* and 4*b* passageway 326 and chamber 328 are defined by barrier layer 322. Nozzle 330 and air purge opening 332 are defined in orifice layer 324. In this particular embodiment passageway 326 may have a generally constant height $d_2$ of about 20 microns. Examples of other configurations are described below in relation to FIG. 6.

Passageway-to-chamber opening 400 has, in one embodiment, a first width $d_3$ of about 10 microns and a height $d_2$ of 20 microns. Passageway 326 tapers outward from the passageway-to-chamber opening 400 to a second width $d_4$ which in one embodiment of about 20 microns proximate air purge opening 332.

Nozzle 330 has a diameter $d_5$, which in one embodiment is about 15 microns measured transverse the fluid path f. Air purge opening 332 extends along a bore axis $b_1$ and has a first diameter $d_6$, which in one embodiment is about 13 microns measured transverse the bore axis and proximate an outer surface 401 of orifice layer 324. In this embodiment air purge opening 332 also has a second larger diameter $d_7$, which in one embodiment is about 20 microns measured proximate inner surface 402 of orifice layer 324.

While in the embodiment of FIGS. 4*a* and 4*b* apertures 320, nozzle 330 and air purge opening 332 are generally depicted as being circular, other suitable embodiments may utilize other geometric shapes such as rectangular and elliptical shapes among others.

During operation, ink, not specifically shown, may flow along fluid path f until it is ejected through nozzle 330. For example ink flows from slot 304 into passageway 326 through apertures 320. Ink then is supplied from passageway 326 to chamber 328 through the passageway-to-chamber openings 400. The ink forms a meniscus 403*a*, 403*b* over nozzle 330 and air purge opening 332, respectively, commensurate with a typical slightly negative gage pressure within slot 304.

As depicted in FIGS. 4*c*-4*f*, ink may be ejected selectively from chamber 328 by energizing a respective heating element 316 sufficiently to heat and to vaporize some of the ink adjacent to the heating element and contained in the chamber. Vaporization of ink contained in chamber 328 may increase pressure within the chamber. When the pressure within the chamber becomes sufficient to overcome the surface tension and pressure at the air fluid interface a droplet of ink 404 is ejected from the chamber's nozzle 330 as illustrated in FIG. 4*e*. Following ejection ink enters chamber 328 and meniscus 403*a* is reformed.

Energizing ink to cause ejection from the chamber also may have other consequences. For example, as the temperature of the ink increases, the solubility of gases in the ink decreases. As a result, gases which are in solution in the ink may 'out-gas' and form bubbles 406*a*, 406*b* in chamber 328 and associated passageway 326. Out-gassing is but one example of how bubbles may occur in the print head. Other sources may be the vaporization process in the chamber, "gulping" air into nozzle during a refill process after an ink drop is ejected, and bubbles carried along with the ink from the ink supply, among other sources.

As shown in FIGS. 4*c*-4*d*, bubbles 406*a*, 406*b* have diameters $d_8$, $d_9$ which in one embodiment are 5 microns and 8 microns respectively. The smallest dimensional constraint proximate the bubbles is passageway width $d_3$, which in one embodiment is 10 microns. Bubbles are able to assume a low energy configuration generally approximating a sphere, based upon the cross-sectional area of passageway 326.

As depicted in FIGS. 4*e*-4*f*, the previously illustrated bubbles (406*a*, 406*b*) have grown and/or have coalesced along with other bubbles into a single larger bubble 406*c*. Bubble 406*c* has a diameter $d_9$ of approximately 10 microns which is similar to the passageway's width $d_3$ proximate the bubble. If the bubble continues to grow, width $d_3$ begins to constrain the bubble from expanding in the x and z dimension and causes the bubble to instead expand in they dimension and therefore deform from a generally spherical shape.

Deforming bubble 406*c* causes a driving force that may move the bubble along passageway 326 away from passageway-to-chamber opening 400 and toward the air purge opening end of passageway 326 which is less constraining in the x-dimension and allows the bubble to achieve a more spherical configuration. The result of the driving force may be seen in FIGS. 4*g*-4*h* where bubble 406*c* has moved along passageway 326 toward the wider air purge opening end of the passageway. As illustrated in FIGS. 4*g*-4*h*, bubble 406*c* has a diameter $d_9$ of about 15 microns which is similar to the passageway's width proximate bubble 406*c*.

As bubble 406*c* continues to expand, x-dimensional constraints continue to provide a driving force for the bubble. As may be seen in FIGS. 4*i*-4*j* in this instance the driving force is sufficient to continue moving bubble 406*c* along the passageway's taper toward air purge opening 332 where the bubble now has a diameter $d_9$ of about 20 microns and is located at the least constraining portion of passageway 326. In this location bubble 406*c* has the largest spherical shape it may, given the x, z constraints of passageway 326. Further bubble growth now is governed by the energy balance between the radius of curvature experienced in the three (x, y, and z) dimensions. In this embodiment the most notable bubble growth is towards the chamber (in y-axis) towards the air purge opening (z-axis), with the bubble seeking equilibrium in these two primary directions of growth.

As may be seen in FIGS. 4*k*-4*l*, bubble 406*c* has continued to expand and is forced by the dimensional constraints of passageway 326 to expand in they and z-dimensions and as such to assume a non-spherical shape.

As seen in FIGS. 4*m*-4*o* bubble 406*c* may continue to grow along the y-dimension back toward the chamber end of the passageway 326 until it reaches a point where the passageway becomes more constrictive than another opening available to the bubble. In this embodiment bubble 406*c* grows toward the chamber 328 until continued expansion down the passageway 326 would require the bubble to assume a higher energy state than expanding into air purge opening 332 and overcoming the surface tension and pressure at the air fluid interface. In this particular embodiment such a point may occur where the passageway's width is less than or equal to the air purge opening's diameter $d_6$. In some embodiments this may occur where the passageway's width is somewhat less than the width $d_6$ of the air purge opening, thus allowing the energy state to become high enough to distend the bubble into the air purge opening and to overcome the meniscus. As the volume of bubble 406*c* continues to increase, the bubble achieves a sufficiently high energy state to overcome the surface tension of meniscus 403*b*. When the energy state of the bubble becomes great enough to overcome the surface tension of the meniscus, the meniscus will 'break' allowing the gas comprising the bubble to evacuate or to be expelled from the print head through the air purge opening 332.

FIG. 4*o* shows print head 204 after the bubble has evacuated from air purge opening 332 and meniscus 403*b* has reformed. Expulsion of the bubble may be facilitated by the capillary pressure of ink proximate the bubble. In some embodiments firing heating element 316 may be energized one or more times to create a pressure surge or surges through the ink to facilitate purging the bubble. Meniscus 403*b* reforms once the gas comprising the bubble is purged from the print head. If additional bubbles form, the process may be repeated.

In this embodiments movement and/or expansion of a bubble in a desired direction within a space such as a passageway may be achieved by providing an environment within the space that tapers or otherwise encourages a bubble to move and/or to expand from a more constraining region of the space into a less constraining region. In this particular embodiment the more constraining region is proximate the chamber and the less constraining region is proximate the air purge opening. This embodiment also selects relative dimensions of openings leading into and out of the passageway to foster bubbles to pass through a desired opening and/or not through other openings. Air purge opening 332 has relatively larger dimensions when compared to apertures 320 and the passageway-to-chamber opening 400 so that a bubble experiences a larger radius of curvature passing through the air purge opening than either the apertures 320 or the passageway-to-chamber opening 400. As such bubbles may be managed within the print head by purging through the air purge opening.

FIGS. 5*a*-5*i* illustrate several exemplary air purge opening configurations.

Figure 5A:
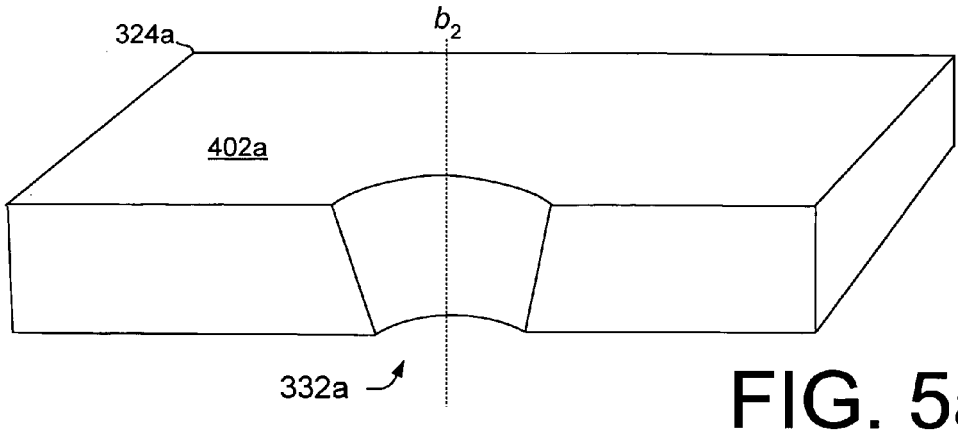
FIG. 5*a* illustrates a cut-away perspective view of a portion of another exemplary fluid ejection device in accordance with one embodiment.
Figure 5B:
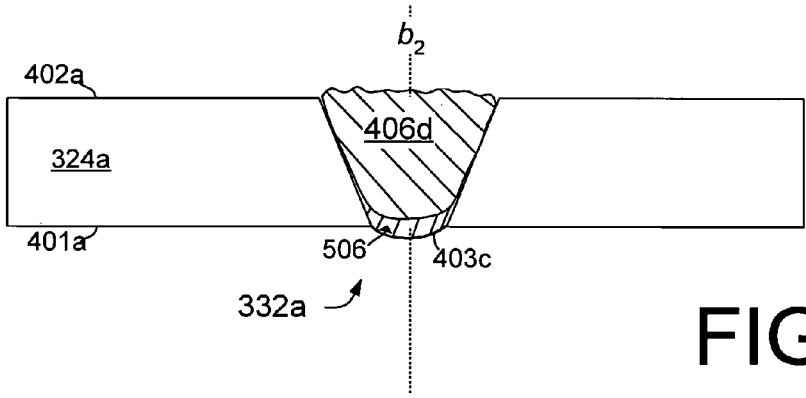
FIG. 5*b* illustrates a cross-sectional view of a portion of the exemplary fluid ejection device illustrated in FIG. 5*a* in accordance with one embodiment.
Figure 5C:
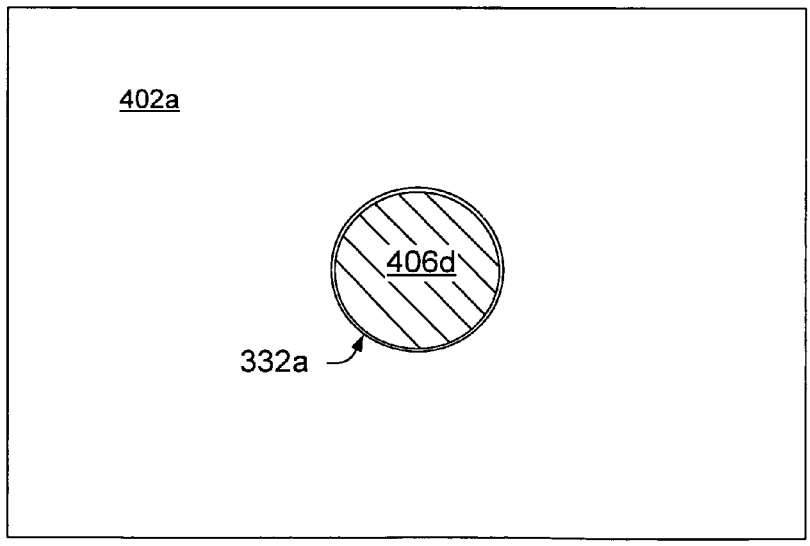
FIG. 5*c* illustrates a top view of a portion of the exemplary fluid ejection device illustrated in FIG. 5*a* in accordance with one embodiment.

FIGS. 5*a*-5*c* show one embodiment of a air purge opening 332*a* formed in orifice layer 324*a*. FIG. 5*a* illustrates a cut-away perspective view of a portion of another exemplary fluid ejection device in accordance with one embodiment. FIG. 5*b* illustrates a cross-sectional view of a portion of the exemplary fluid ejection device illustrated in FIG. 5*a* in accordance with one embodiment. FIG. 5*c* illustrates a top view of a portion of the exemplary fluid ejection device illustrated in FIG. 5*a* in accordance with one embodiment.

Air purge opening 332*a* extends through orifice layer 324*a* between a first surface 401*a* and a second generally opposing surface 402*a* and along bore axis $b_2$ which is generally orthogonal to first surface 401*a*. Orifice layer 324*a* is configured for second surface 402*a* to be positioned toward a print head's barrier layer as described above in relation to FIG. 3.

In this embodiment air purge opening 332*a* is generally frusto-conical shaped. Other exemplary shapes include hemispherical, bowl-shaped and cylindrical among others.

As may be appreciated from FIGS. 5*b*-5*c*, ink 506 may get trapped within air purge opening 332*a* when a portion of bubble 406*d*, shown FIGS. 5*b*-5*c*, expands into the air purge opening. Ink 506 may be trapped proximate second surface 402*a* when bubble 406*d* expands into the air purge opening 332*a* and generally conforms to the circular shape of the air purge opening as may be seen in FIG. 5*c*. Ink 506 trapped in the air purge opening 332*a* may increase in some instances the pressure sufficient to overcome the surface tension and pressure at the air fluid interface. Alternatively or additionally, the trapped ink may be expelled from a print head with the bubble when the meniscus is overcome.

Figure 5D:
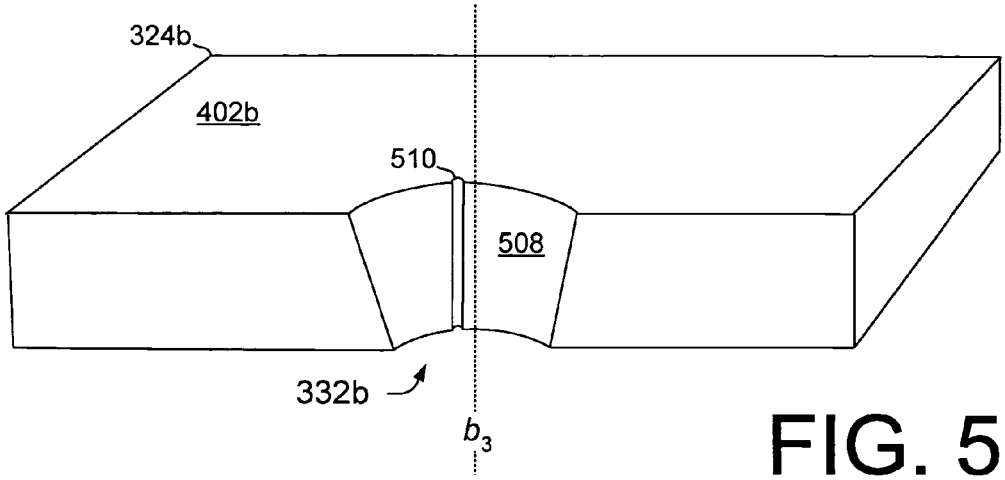
FIG. 5*d* illustrates a cut-away perspective view of a portion of another exemplary fluid ejection device in accordance with another embodiment.
Figure 5E:
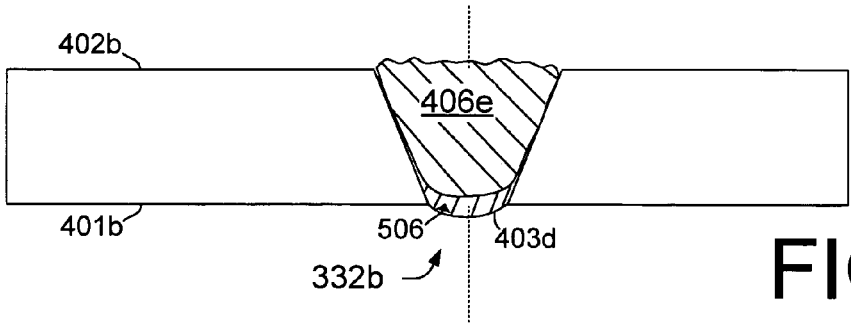
FIG. 5*e* illustrates a cross-sectional view of a portion of the exemplary fluid ejection device illustrated in FIG. 5*d* in accordance with another embodiment.
Figure 5F:
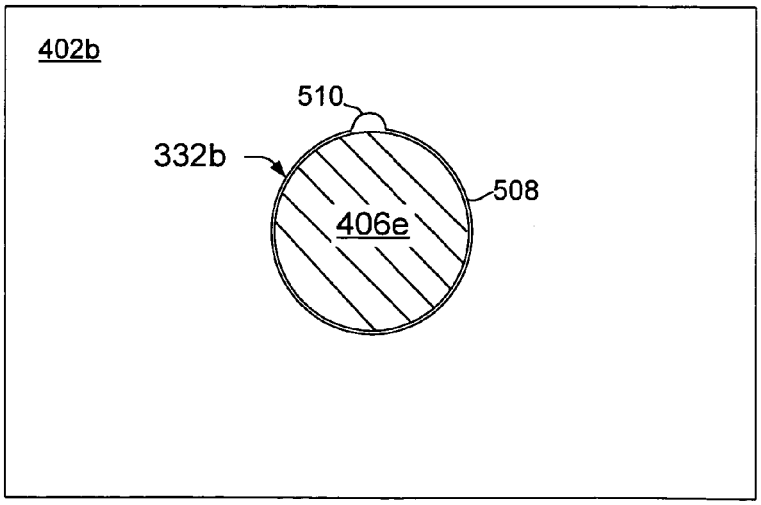
FIG. 5*f* illustrates a top view of a portion of the exemplary fluid ejection device illustrated in FIG. 5*d* in accordance with another embodiment.

FIGS. 5*d*-5*f* show an alternative embodiment of air purge opening configuration that tends to allow ink to evacuate from air purge opening 332*b* back into the print head in the presence of bubble 406*e* shown in FIGS. 5*e*-5*f*. FIGS. 5*d*-5*f* illustrate views similar to those of FIGS. 5*a*-5*c* respectively. In this embodiment air purge opening 332*b* has a central region 508 joined with at least one capillary region 510. In this embodiment central region 508 is generally frusto-conical shaped and extends through the orifice layer 324*b* along bore axis $b_3$. Capillary region 510 extends at least part way through orifice layer 324*b*. In this embodiment, capillary region 510 extends entirely between first surface 401*b* and second surface 402*b*. In this embodiment capillary region 510 generally approximates a portion of a cylinder. Other shapes may provide a similar functionality.

As may be appreciated from FIG. 5*f*, bubble 406*e* tends to expand to fill central region 508, but generally does not fill capillary region 510 which provides a path for ink 506 to evacuate back past first surface 401*b* into the overlying portions of a print head. Providing an evacuation path for the ink may allow bubble 406*e* to more easily to overcome the surface tension and pressure at the air fluid interface and prevent expulsion of ink from air purge opening 332.

Figure 5G:
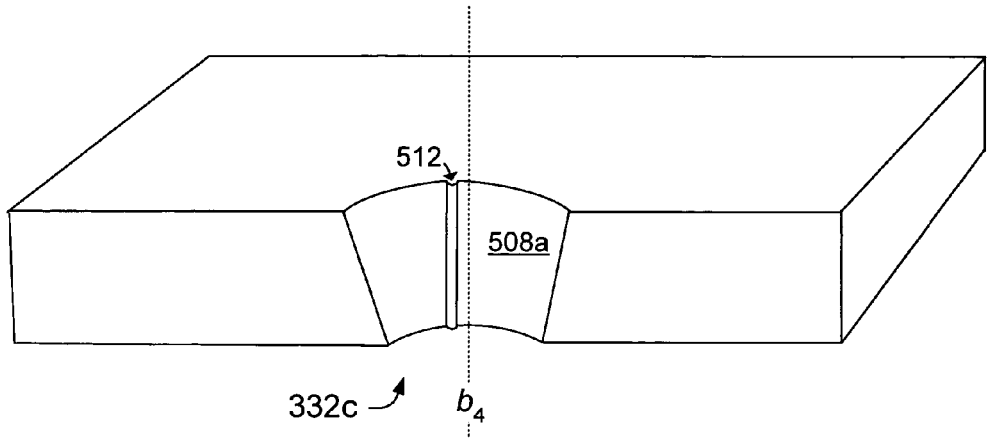
FIG. 5*g* illustrates a cut-away perspective view of a portion of another exemplary fluid ejection device in accordance with an additional embodiment.
Figure 5H:
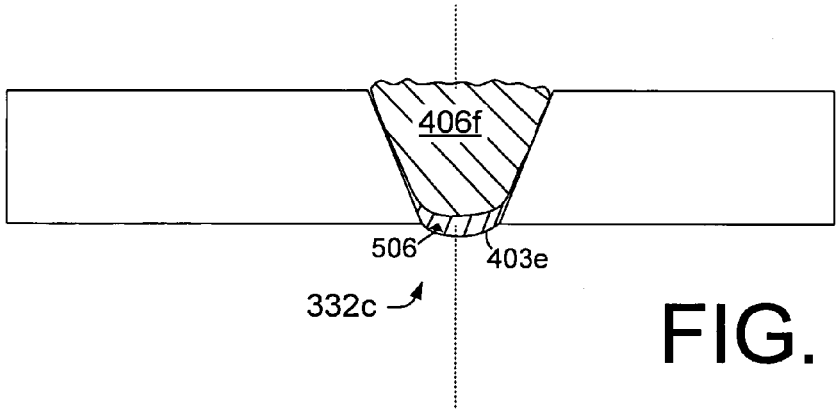
FIG. 5*h* illustrates a cross-sectional view of a portion of the exemplary fluid ejection device illustrated in FIG. 5*g* in accordance with an additional embodiment.
Figure 5I:
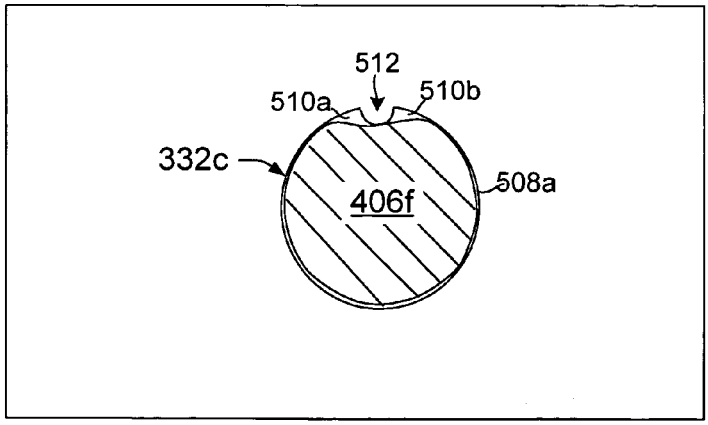
FIG. 5*i* illustrates a top view of a portion of the exemplary fluid ejection device illustrated in FIG. 5*g* in accordance with an additional embodiment.

FIGS. 5*g*-5*i* show an additional embodiment of an air purge opening configuration that tends to allow ink to evacuate from air purge opening 332*c* back into the print head in the presence of a bubble 406*f*. FIGS. 5*g*-5*i* illustrate views similar to those of FIGS. 5*d*-5*f* respectively. In this embodiment air purge opening 332*c* has a central region 508*a*. A rib of orifice material indicated generally at 512 extends into central region 508*a*. In this embodiment rib 512 generally approximates a portion of a cylinder. Other shapes may provide a similar functionality.

As may be appreciated from FIG. 5*i*, rib 512 causes bubble 406*f* to assume a configuration which leaves two capillary regions 510*a*, 510*b* for ink to evacuate along.

The skilled artisan should recognize other suitable air purge opening configurations may be utilized.

Figure 6:
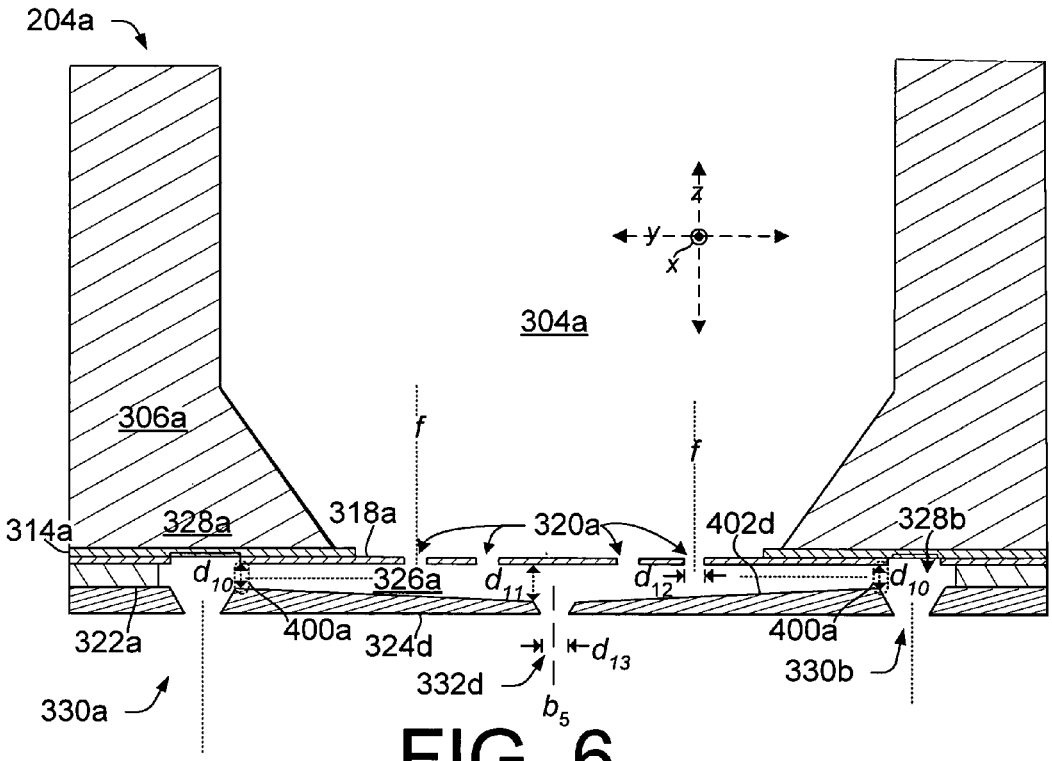
FIG. 6 illustrates an enlarged cross-sectional view of a portion of another exemplary fluid ejection device in accordance with one embodiment.
Figure 6A:
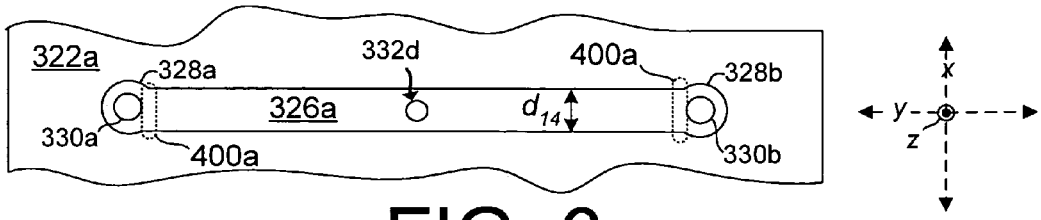
FIG. 6*a* illustrates a top view of a portion of the embodiment of the exemplary fluid ejection device shown in FIG. 6.

FIGS. 6-6*a* illustrate another exemplary print head configuration. FIG. 6 illustrates a cross-sectional view of print head 204*a* similar to that illustrated in FIG. 3, while FIG. 6*a* illustrates a view similar to the view illustrated in FIG. 4*b*. In this embodiment a pair of chambers 328*a*, 328*b* formed in barrier layer 322*a* and positioned on opposing sides of slot 304*a* is supplied via a common passageway 326*a*. Ink is supplied along fluid path f from slot 304*a* into passageway 326*a* through apertures 320*a* formed in filter 318*a*. Nozzles 330*a*, 330*b* are positioned below chambers 328*a*, 328*b* respectively.

An air purge opening 332*d* is positioned along passageway 326*a* between chambers 328*a*, 328*b*. In this embodiment, the passageway's height $d_{10}$ proximate chamber 328*a* is less than height $d_{11}$ proximate air purge opening 332*d*. The passageway's height in the z-direction between filter 318*a* and orifice layer 324*d* is generally tapered from the value at $d_{10}$ to the value at $d_{11}$. In this particular embodiment the orifice layer's inner surface 402*d* is patterned utilizing a gray-scale etch to achieve the tapered configuration. Other embodiments may achieve a tapered passageway height in the z-direction by creating the taper in the filter 318*a*, thin-films 314*a* and/or substrate 306*a* among others.

The tapered configuration of passageway 326*a* tends to cause bubbles located in the passageway to move and/or to expand toward air purge opening 332*d*. The relative dimensions of the air purge opening encourage bubbles to exit passageway 326*a* through the air purge opening rather than through the apertures 320*a* or into the chamber 328*a*.

In this embodiment, apertures 320*a* extend through filter 318*a* along fluid path f and have a diameter $d_{12}$ of 10 microns which is less than a diameter $d_{13}$ of 15 microns taken along the air purge opening's bore axis $b_5$. The air purge opening's diameter $d_{13}$ is greater than at least one of the dimensions leading from passageway-to-chamber opening 400*a*. In this particular embodiment the passageway-to-chamber opening dimensions comprise height $d_{10}$ of 10 microns in the z-direction and width $d_{14}$ of 20 microns in the x-direction. Passageway-to-chamber opening height dimension $d_{10}$ of 10 microns is more constraining than the 15 micron diameter $d_{13}$ of air purge opening 332*a*. Likewise, 10 micron diameter $d_{12}$ of aperture 320*a* is more constraining than the air purge opening's 15 microns. As a result, a bubble expanding in passageway 326*a* will tend to pass through air purge opening 332*d* rather than through apertures 320*a* or into passageway-to-chamber opening 400*a*.

Figure 6B:
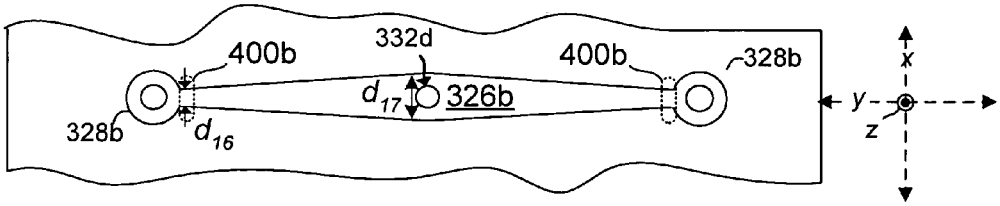
FIG. 6*b* illustrates a top view of an alternative configuration of a portion of the embodiment of the exemplary fluid ejection device shown in FIG. 6.

FIG. 6*b* illustrates an alternative passageway configuration which may aid in moving bubbles toward air purge opening 332*d*. This particular embodiment maintains the tapered passageway height described in relation to FIG. 6. This embodiment further adds a tapered passageway width to further encourage a bubble in passageway 326*b* to move and/or to expand toward air purge opening 332*d* and away from chamber 328*b*.

Passageway 326*b* has a width $d_{16}$ at its passageway-to-chamber opening 400*b* that is narrower than its width $d_{17}$ proximate to and at air purge opening 332*d*. The passageway tapers between these two values. Such a configuration may promote bubble movement toward the air purge opening 332*d*. As the bubble continues to grow with out-gassing or coalescing it will grow toward the largest dimension in the system. So the bubble grows within passageway 326*b* along the y-axis toward air purge opening 332*d* until it distends into air purge opening 332*d* and overcomes its meniscus. At this point the bubble may purge from the system through the air purge opening.

Figure 7:
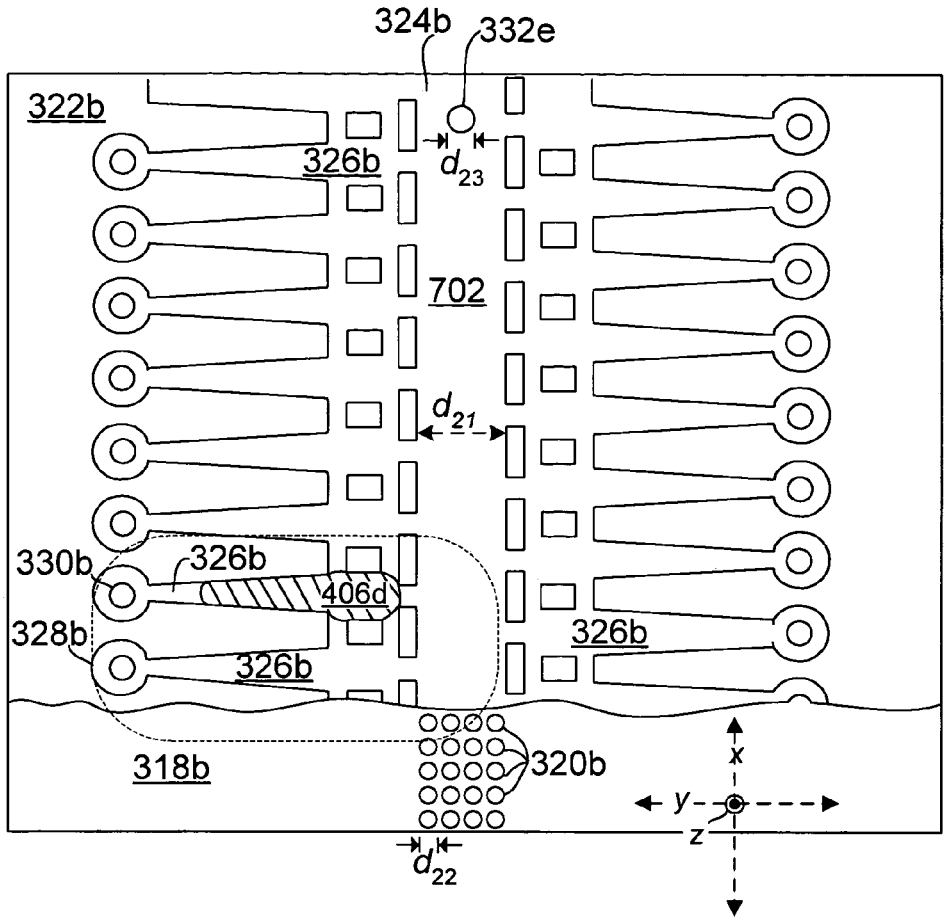
FIG. 7 illustrates a top view of a portion of another exemplary fluid ejection device in accordance with one embodiment.
Figure 7A:
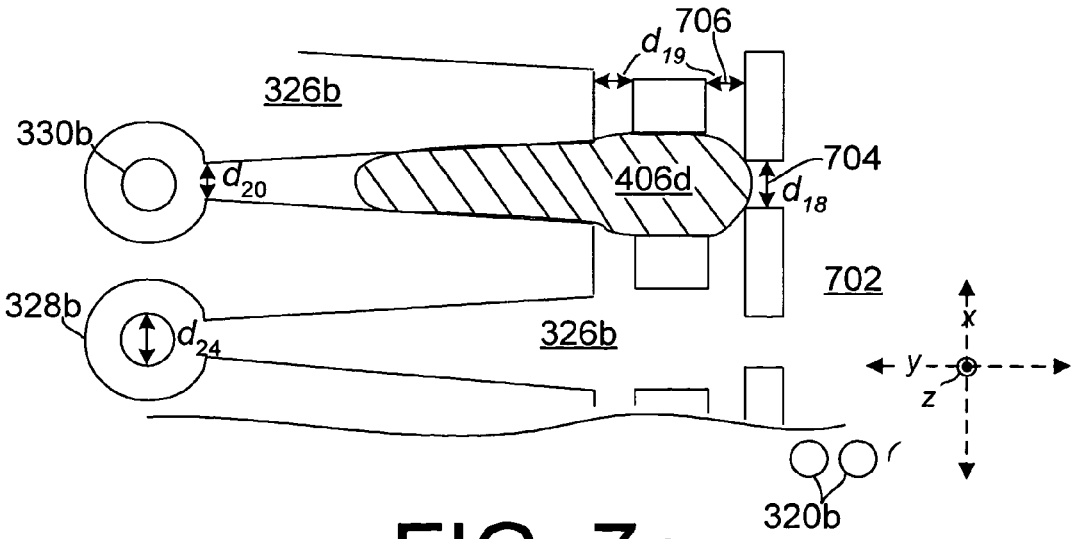
FIG. 7*a* illustrates an enlarged top view of a portion of the embodiment of the exemplary fluid ejection device shown in FIG. 7 in accordance with one embodiment.

FIGS. 7-7*a* illustrate still another exemplary print head configuration. FIG. 7 illustrates a top view of filter 318*b*, barrier layer 322*b* and orifice layer 324*b* without the overlying substrate. For the purposes of illustration, filter 318*b* is shown partially cut-away. FIG. 7*a* shows a somewhat enlarged view of a portion of the components as indicated in FIG. 7.

This embodiment employs a manifold region 702 formed in barrier layer 322*b*. Manifold region 702 may receive ink through apertures 320*b*. Ink may enter an individual passageway 326*b* from one or more openings. Examples of openings, in various embodiments, may include apertures 320*b*, a manifold-to-passageway opening 704 and a passageway-to-passageway opening 706. Manifold-to-passageway opening 704 has a dimension $d_{18}$ that is larger than a dimension $d_{19}$ of passageway-to-passageway opening 706. In this embodiment the manifold-to-passageway dimension $d_{18}$ is about 12 microns while the passageway-to-passageway dimension $d_{19}$ is about 9 microns. Passageway-to-chamber dimension $d_{20}$ comprises 10 microns.

A bubble that is produced in, or otherwise occurs in an individual passageway 326*b* may grow, such as with continued outgassing, and will favor exiting through an opening into or out of the passageway having the least constrictive minimum dimension. This embodiment maintains a generally uniform distance of 20 microns in the z-direction as defined between orifice layer 324*b* and filter 318*b*. As such, the least constrictive opening comprises a manifold-to-passageway opening 704. Bubble 406*c* constrained in passageway 326*b* will tend to move through manifold-to-passageway opening 704 when a sufficient energy state is reached. Bubble 406*c* will not tend to migrate between adjacent passageways given that the smaller passageway-to-passageway openings 706 require a higher energy configuration to pass through than the manifold-to-passageway opening 704.

In this embodiment manifold region 702 has a width $d_{21}$ of about 50 microns taken along the short or y-axis, and a length in the x-direction similar to a length of an overlying slot. Bubbles in manifold region 702 tend to expand along the manifold region rather than pass through the more constricted dimensions of the manifold-to-passageway openings 704 or through apertures 320*b* which have a diameter $d_{22}$ of 9 microns. Air purge opening 332*e* having a diameter $d_{23}$ of 15 microns may provide the largest dimensional opening available to the bubbles as the manifold is filled in the x- and y-directions by the bubble. So bubbles in the manifold region 702 may expand within the manifold region until the dimensional constraints cause them to purge from air purge opening 332*e*.

In an alternative embodiment bubbles may be managed without an air purge opening. Instead, the relative dimensions of the openings into and out of a passageway may be selected to purge the bubbles out a respective nozzle. By making the passageway-to-chamber dimension $d_{20}$ and the nozzle diameter $d_{24}$ larger than the other passageway openings such as the manifold-to-passageway opening 704 and the passageway-to-passageway openings 706 a bubble when constricted in the passageway may migrate out through the nozzle without migrating into adjacent passageways and potentially occluding ink flow therein.

Figure 8:
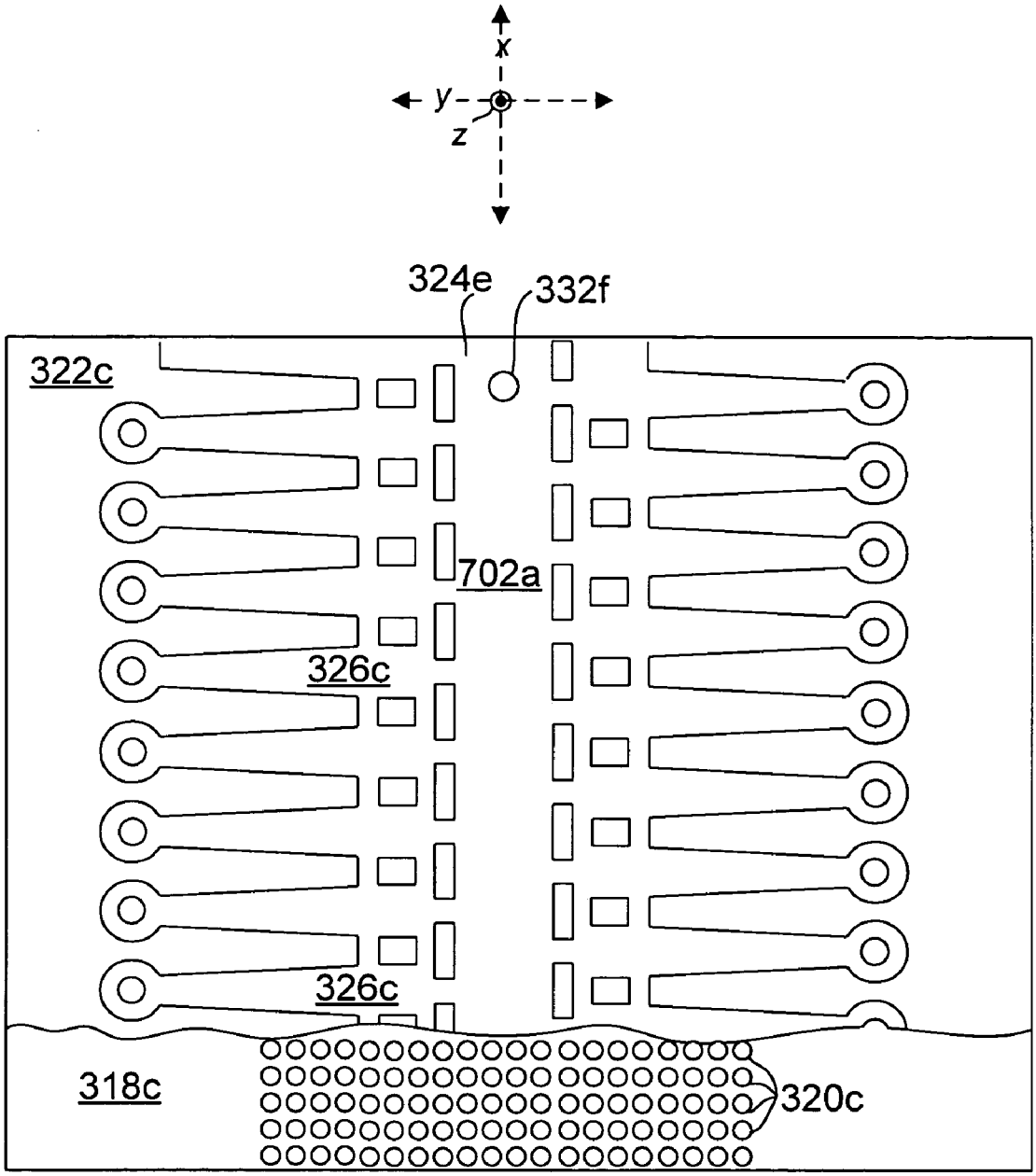
FIG. 8 illustrates a top view of a portion of another exemplary fluid ejection device in accordance with one embodiment.

FIG. 8 illustrates an embodiment similar to that shown in FIG. 7. In this view orifice layer 324*e* underlies barrier layer 322*c* which underlies filter 318*c*. In this embodiment apertures 320*c* are positioned over passageways 326*c* as well as over the manifold region 762*a*. The dimensions are identical to those recited in relation to FIG. 7 so bubbles tend to migrate from the passageways 326*c* into the manifold region rather than into adjacent passageways 326*c* or through apertures 320*c*. Once in the manifold region 702*a*, bubbles migrate out of air purge opening 332*f* rather than back into the passageways.

In this embodiment individual passageways 326*c* may receive ink through apertures 320*c* positioned over the passageway and/or from adjacent passageways even when a bubble is occupying part or all of manifold region 702*a*. This configuration may contribute to maintaining adequate ink flow to the chambers in the presence of a bubble in the manifold region.

The incidence of bubbles in a print head may vary depending on the operating status of the print cartridge. When the print cartridge is used periodically, ink may solidify or may crust proximate an air purge opening. Some embodiments may position a firing heating element or other energizing device proximate an air purge opening. The heating element may be energized from time to time, such as when the print head is positioned over a service station. Energizing the heating element may eject ink which may expel any crusted or dried ink proximate the air purge opening which may otherwise begin to obstruct the air purge opening.

While specific examples of suitable dimensions are provided above for the purposes of explanation, the skilled artisan should recognize that many other suitable dimensions would be equally suitable.

The embodiments described above provide various structures and methods for managing gas bubbles as they occur in a fluid ejection device, such as a print head. Other exemplary embodiments may manage bubbles in other ways and/or in other locations. For example one suitable embodiment may position a bubble managing structure at a convenient location along the fluid-feed path. Another example may position air purge openings at either end of the nozzle columns shown in FIGS. 7 & 8. The structure may be designed to proactively reduce an amount of gas contained in ink subsequently supplied to the print head by producing a bubble through nucleation and maintaining continual outgassing through localized heating of the ink. The structure may be configured to define a space through which the fluid-feed path passes.

In one such embodiment a structure may define a space through which ink flows. The ink may be heated as it passes through the structure to cause outgassing and resultant bubbles. The bubbles may be managed by purposefully selecting the relative size and shape of the openings coupled to the space in combination with the shape of the space. For example ink may travel along the fluid-feed path and may enter the space through a first opening and may exit through a second opening. A third opening having a minimum dimension larger than a minimum dimension of either of the first and second openings may allow bubbles to exit the space and further to be effectively separated from the ink. This process may be further augmented by tapering the shape of the space so that a least confining region of the space is proximate the third opening. This is but one additional exemplary embodiment for managing bubbles. The skilled artisan should recognize other suitable configurations.

The described embodiments may provide methods and systems for managing bubbles in a print head or other fluid ejection device. The bubbles may be managed by controlling the relative dimensions of opening leading into or out of a space such as an ink-feed passageway. Some embodiments utilize an air purge opening as one of the openings and select relative dimensions which promote migration of a bubble through the air purge opening rather than other openings.

Although the inventive concepts have been described in language specific to structural features and methodological steps, it is to be understood that the appended claims are not necessarily limited to the specific features or steps described. Rather, the specific features and steps are disclosed as forms of implementation.

What is claimed is:

1. A fluid ejection device comprising:

a chamber configured to eject fluid droplets through a nozzle;

a fluid-feed passageway configured to supply fluid to the chamber through a first opening and configured to receive fluid through at least a second different opening; and, a third opening coupled with the fluid-lead passageway where the fluid-feed passageway is further configured to constrain bubbles to form into a large bubble until a driving force associated with the large bubble causes the large bubble to be expelled out from the fluid ejection device through the third opening.

2. The fluid ejection device of claim 1, wherein the third opening extends to an outer surface of the fluid ejecting device from which the fluid droplets are ejected.

3. The fluid ejection device of claim 1, wherein the third opening comprise an opening formed in an orifice layer.

4. The fluid ejection device of claim 1, wherein the first opening extends along a first bore axis and the at least a second different opening extends along a second bore axis and the third opening extends along a third bore axis and wherein a minimum dimension of the third opening taken orthogonally to the third bore is greater than a minimum dimension of the first opening taken orthogonally to the first bore axis and a minimum dimension of the at least a second opening taken orthogonally to the second bore axis.

5. The fluid ejection device of claim 1, where the fluid-feed passageway narrows in dimension toward the chamber and widens in dimension toward the third opening to cause bubbles expanding in the fluid-feed passageway to move toward the third opening.

6. The fluid ejection device of claim 1, wherein the third opening comprises a central region and a capillary region.

7. The fluid ejection device of claim 1, wherein the third opening comprises a central region and a rib.

8. The fluid ejection device of claim 1, wherein the air purge opening is postponed over the fluid-feed passageway.

9. The fluid ejection device of claim 1 embodied as a print head.

10. A fluid ejection device comprising:

a chamber configured to eject fluid through a nozzle in a surface of the fluid ejecting device:

a fluid passageway configured to receive fluid through at least a first opening and to deliver fluid through at least a second different opening to the chamber; and, a means for removing bubbles from the passageway where the fluid passageway is further configured to constrain bubbles to form into a large bubble until a driving force associated with the large bubble causes the large bubble to be expelled by the means for removing bubbles through an air purge opening formed through an outer surface of the fluid ejection device.

11. The fluid ejection device of claim 10, wherein the means for removing is configured to remove the bubbles through the surface.

12. A fluid ejecting device comprising:

a pair of chambers configured to eject fluid;

a fluid-feed passageway extending generally between the pair of chambers and configured to supply fluid to the pair of chambers through a pair of opening; and, at least one other opening interposed along the passageway and through an outer surface of the fluid ejection device to remove air from the fluid eject on device where the fluid-feed passageway is further configured to constrain air bubbles to form into a large air bubble until a driving force associated with the large air bubble causes the large air bubble to be expelled out of the at least one other opening.

13. The fluid ejection device of claim 12, wherein the fluid-feed passageway is generally tapered from the openings toward the at least one other opening.

14. The fluid ejection device of claim 12, wherein the fluid-feed passageway has a first dimension measured orthogonally to a length between the openings that is less than a second dimension measured orthogonally to the length and proximate the at least one other opening.

15. The fluid ejection device of claim 14, wherein the fluid-feed passageway has a third dimension measured orthogonally to the length s and orthogonally to the first dimension that is less than a fourth dimension measured orthogonally to the length and orthogonally to the second dimension and proximate the at least one other opening.

16. The fluid ejection device of claim 12, wherein the pair of chambers are configured to eject fluid through first type nozzles formed in an orifice layer, and wherein the at least one other opening comprises a second type nozzle formed in the orifice layer.

17. The fluid ejection device of claim 14, wherein the one other opening comprises a central region and a capillary region.

18. The fluid ejection device of claim 14, wherein the one other opening comprises a central region and a rib formed thereon.

19. A fluid ejection device comprising:

at least one chamber for ejecting fluid received along a fluid-feed path;

the fluid-feed path extending through a first opening into a fluid-feed passageway and into the chamber through a second opening, wherein the first opening has a minimum dimension measured orthogonally to the fluid-feed path that is less than a minimum dimension of the second opening; and, an air purge opening extending along a bore axis and fluidly coupled to the fluid-feed passageway, the air purge opening being formed through an outer surface of the fluid ejection device, and wherein the air purge opening has a minimum dimension measured orthogonally to the bore axis of the air purge opening that is greater than the minimum dimension of the second opening where the fluid-feed passageway is further configured to constrain sir bubbles to form into a large air bubble until a driving force associated with the large air bubble causes the large air bubble to be expelled out of the air purge opening.

20. The fluid ejection device of claim 19, wherein the fluid-feed passageway tapers from a relatively wide region located proximate the air purge opening to a relatively narrow region located distal the air purge opening and proximal the chamber.

21. The fluid ejection device of claim 19, wherein the fluid-feed passageway tapers from a relatively wide region located proximate the air purge opening to a first relatively narrow region located distal the air purge opening and proximal the first opening and tapers from the relatively wide region to a second relatively narrow region proximate the second opening.

22. The fluid ejection device of claim 19, wherein the air purge opening comprises a central region and a capillary region.

23. The fluid ejection device of claim 19, wherein the air purge opening comprises a central region and a rib formed on the central region.

24. A fluid ejection device comprising:

at least one chamber for ejecting fluid through a first opening, the at least one chamber configured to receive fluid from a fluid-feed passageway through a second opening; and, another opening fluidly coupled to and formed along the fluid-feed passageway, said another opening configured to remove air from the fluid ejection device;

wherein the fluid-feed passageway tapers from a first dimension at a location proximate the another opening to a second dimension at a location proximate the second opening the fluid-feed passageway further constraining air bubbles to form into a large air bubble until a driving force associated with the large air bubble causes the large air bubble to be expelled out of the another opening.

25. The fluid ejection device of claim 24, wherein the another opening has a minimum dimension measured orthogonally to a bore axis of the another opening that is less than a minimum dimension of the first opening measured orthogonally to a bore axis of the first opening.

26. The fluid ejection device of claim 24, wherein the another opening comprises a central region and a capillary region.

27. The fluid ejection device of claim 24, wherein the another opening comprises a central region and a rib formed on the central region.

* * * * *

UNITED STATES PATENT AND TRADEMARK OFFICE

CERTIFICATE OF CORRECTION

PATENT NO. : 7,625,080 B2
APPLICATION NO. : 10/872215
DATED : December 1, 2009
INVENTOR(S) : Jeffery S. Hess et al.

It is certified that error appears in the above-identified patent and that said Letters Patent is hereby corrected as shown below:

In column 11, line 13, in Claim 1, delete "fluid-lead" and insert -- fluid-feed --, therefor.

In column 11, line 23, in Claim 3, delete "comprise" and insert -- comprises --, therefor.

In column 11, line 29, in Claim 4, delete "is" and insert -- axis is --, therefor.

In column 11, line 44, in Claim 8, delete "postponed" and insert -- positioned --, therefor.

In column 11, line 49, in Claim 10, delete "device:" and insert -- device; --, therefor.

In column 11, line 63, in Claim 12, delete "ejecting" and insert -- ejection --, therefor.

In column 11, line 67, in Claim 12, delete "opening;" and insert -- openings; --, therefor.

In column 12, line 3, in Claim 12, delete "eject on" and insert -- ejection --, therefor.

In column 12, line 19, in Claim 15, after "length" delete "s".

In column 12, line 52, in Claim 19, delete "sir" and insert -- air --, therefor.

Signed and Sealed this

Sixteenth Day of March, 2010

David J. Kappos

David J. Kappos
*Director of the United States Patent and Trademark Office*